US008251663B2

(12) United States Patent
Ilves et al.

(10) Patent No.: US 8,251,663 B2
(45) Date of Patent: Aug. 28, 2012

(54) IMPELLER FOR A PUMP UNIT AND ASSOCIATED PUMP UNIT

(75) Inventors: Lasse Ilves, Helsinki (FI); Heikki Yli-Korpela, Vantaa (FI)

(73) Assignee: Grundfos Management A/S, Bjerringbro (DK)

( * ) Notice: Subject to any disclaimer, the term of this patent is extended or adjusted under 35 U.S.C. 154(b) by 950 days.

(21) Appl. No.: 12/158,462

(22) PCT Filed: Dec. 13, 2006

(86) PCT No.: PCT/EP2006/011990

§ 371 (c)(1), (2), (4) Date: Nov. 21, 2008

(87) PCT Pub. No.: WO2007/079890

PCT Pub. Date: Jul. 19, 2007

(65) Prior Publication Data

US 2009/0169374 A1 Jul. 2, 2009

(30) Foreign Application Priority Data

Dec. 21, 2005 (EP) ..... 05028030

(51) Int. Cl.

| | |
|---|---|
| ***B63H 1/16*** | (2006.01) |
| ***B64C 11/00*** | (2006.01) |
| ***B64C 27/20*** | (2006.01) |
| ***F01D 5/22*** | (2006.01) |
| ***F03D 11/00*** | (2006.01) |

(52) U.S. Cl. ..... 416/186 R; 416/223 R; 416/228; 416/235; 416/237; 415/206; 415/210.1

(58) Field of Classification Search ..... 416/186 R, 416/223 R, 228, 235, 237; 415/206, 210.1
See application file for complete search history.

(56) References Cited

U.S. PATENT DOCUMENTS

| | | | | |
|---|---|---|---|---|
| 6,220,819 | B1 * | 4/2001 | Chien et al. | 416/186 R |
| 6,551,058 | B2 * | 4/2003 | Nowack | 415/140 |
| 7,241,114 | B2 * | 7/2007 | Koeppler | 416/186 R |
| 2002/0119049 | A1 * | 8/2002 | Chien et al. | 416/223 R |

FOREIGN PATENT DOCUMENTS

| | | | |
|---|---|---|---|
| DE | 2442446 | A1 | 3/1976 |
| DE | 10050108 | A1 | 6/2002 |
| EP | 0237921 | A3 | 9/1987 |

* cited by examiner

*Primary Examiner* — Toan Le
(74) *Attorney, Agent, or Firm* — Panitch Schwarze Belisario & Nadel LLP

(57) ABSTRACT

An impeller is provided for a pump unit, in particular for a waste water pump unit, having two cover plates (2, 4), which are spaced apart from one another in the axial direction (X) and are connected to one another by at least one connecting element (8). The impeller has at least one blade (12, 14) which is arranged between the two cover plates (2, 4) and extends from an inner diameter of the impeller to an outer diameter of the impeller. The blade (12, 14) has a continuous slot (16), which extends from the edge (22, 24) of the blade (12, 14) which is situated at the inner diameter to the edge (26, 28) of the blade (12, 14) which is situated at the outer diameter. A pump unit is also provided having an impeller of this type.

17 Claims, 2 Drawing Sheets

IMPELLER FOR A PUMP UNIT AND ASSOCIATED PUMP UNIT

CROSS-REFERENCE TO RELATED APPLICATIONS

This application is a Section 371 of International Application No. PCT/EP2006/011990, filed Dec. 13, 2006, which was published in the German language on Jul. 19, 2007, under International Publication No. WO 2007/079890 and the disclosure of which is incorporated herein by reference.

BACKGROUND OF THE INVENTION

The invention relates to an impeller for a pump unit, in particular for a waste-water pump unit, as well as to a pump unit with such an impeller. There are problems with contamination of the applied pump units wherever contaminated fluids are to be delivered, for example in the field of delivery of waste-water. In particular, long-fibered contamination may permanently cling to the blades of the impellers of the pump units, which leads to a compromise of the operation and even to damage of the pump unit in the extreme case. For this reason, in waste-water pumps impellers are often applied, which merely have one flow channel. With these impellers, there are no edges or walls, to which long-fibered contamination may cling. Another possibility is to design the impellers in an open manner, so that contamination may not get stuck on the blades. These designs, however, have the disadvantage that the efficiency of the pump units worsens.

BRIEF SUMMARY OF THE INVENTION

It is therefore an object of the invention to provide an improved impeller for a pump unit, as well as to provide a pump unit with such an impeller, which avoids the attachment of contamination, and simultaneously permits an increased efficiency.

This object is achieved by an impeller for a pump unit, in particular for a waste-water pump assembly, having two cover disks spaced from one another in the axial direction (X), which are connected to one another via at least one connection element, and at least one blade, which is arranged between the two cover disks and which extends from an inner diameter of the impeller to an outer diameter of the impeller, wherein the blade comprises a continuous gap, which extends from the edge of the blade situated at the inner diameter to the edge of the blade situated at the outer diameter. The object is also achieved by a pump unit having the above described impeller and used for a waste-water pump assembly.

The impeller is designed in a closed manner, i.e., it comprises two cover disks spaced from one another in the axial direction, i.e., in the direction of the rotation axis, between which at least one blade is arranged for forming a flow channel for delivering the fluid. The two cover disks are firmly connected to one another via at least one connection element, so that they are held at a defined distance to one another. The at least one blade extends from an inner diameter, i.e., from a central region of the impeller situated in the region of the rotation axis, to an outer diameter of the impeller. The blade thus extends in the known manner in the impeller in the radial direction from the inside to the outside, wherein it may have a curvature for improving the flow guidance. The blade serves for conveying the fluid and forms a flow channel leading outwardly to the periphery of the impeller, in which flow channel the fluid is accelerated on rotation of the impeller.

According to the invention, the impeller is designed in a manner such that it comprises a continuous gap. This gap extends from the edge situated on the inner diameter, i.e., facing the rotation axis, to the edge of the impeller situated on the outer diameter, i.e., the edge which faces the outer periphery of the impeller. The gap thus extends along the blade from the inner region of the impeller to the outside.

The arrangement of this gap has the advantage that long-fibered contamination, which with conventional impellers would remain on the inner edge, i.e., on the edge of the blade situated on the inner diameter, here are conveyed through the gap with the fluid to the outer periphery of the impeller. This means that the contamination does not remain clinging on the edge of the blade, but may move through the gap and the impeller to the outer periphery of the impeller, and there, may be flushed away with the fluid flow delivered by the impeller. The danger of contamination accumulating in the impeller is significantly reduced in this manner. Furthermore, the efficiency of such an impeller is greater than with an impeller formed in an open manner.

Preferably, the described blade is only connected to one of the two cover disks. This means that the blade extends in the axial direction proceeding from one of the two cover disks, and the continuous gap is formed between the free longitudinal edge of the blade which extends from the inside to the outside, and the adjacent second cover disk. The blades thereby may be formed as one piece with the first cover disk, to which it is connected.

The gap is further preferably arranged such that the blade is divided into two blade parts, of which each is only connected to one of the two cover disks. This means that blade parts lying essentially opposite one another are formed on the two cover disks, and proceeding from the respective cover disk to which they are connected, extend to the other cover disk. The blades are thereby arranged in such a manner, or such an axial length is selected, that the two blade parts with their free longitudinal edges, i.e., the longitudinal edges extending from the inner diameter to the outer diameter of the impeller, do not contact. The continuous gap is then formed between these two longitudinal edges, and this gap extends from the inner diameter to the outer diameter of the impeller through the whole blade, so that contamination may be led away through this gap to the outer periphery of the impeller.

The two blade parts are preferably arranged in the region of the gap offset to one another in the peripheral direction of the impeller. This means that the free longitudinal edges of the two blade parts do not lie precisely opposite one another, but are offset to one another in the peripheral direction, so that a gap is formed between the two blade parts in the peripheral direction, which extends continuously from the inner to the outer diameter of the blade. This means that the free longitudinal edges of the blades are spaced from one another in the peripheral direction.

Further preferably, the blade parts are formed so long in the axial direction, that they overlap one another in the region of the gap in the axial direction. With this arrangement, the blade parts, i.e., at least the blade parts facing the gap, are offset to one another in the peripheral direction, so that the free ends of the blade parts may extend past one another in an overlapping manner. By way of the overlapping in the axial direction, one succeeds in there being no distance in the axial direction between blade parts facing one another, so that only one gap is created between the blade parts, whose width extends in the peripheral direction. This means that the blade parts are spaced from one another in the peripheral direction in the region of their free longitudinal edges. A free through-flow of the fluid through the gap on rotation of the impeller is prevented by the fact that no axial distance between the blade parts is given, so that the efficiency loss on account of the gap is kept small.

According to a special embodiment, the overlapping of the blade parts is designed such that the overlapping changes, and in particular reduces, in the course of the blade from the inner to the outer diameter of the impeller. In this manner, it is possible to improve the passage capability of the gap for contamination, from the inner diameter towards the outer diameter, so that the contamination which has once penetrated into the gap at the inner diameter, may be safely led out of the gap at the outer periphery of the impeller, and does not get stuck in the gap.

Thus, preferably, the gap may also be designed such that it widens in the course of the blade from the inner to the outer diameter of the impeller. With overlapping blade parts, the gap may in particular widen in the peripheral direction. It is also ensured by way of this design, that the contamination which has entered the gap, may be safely conveyed out of the gap and does not accumulate there.

The impeller is particularly preferably designed such that several of the previously described blades comprising a continuous gap are arranged between the two cover disks. Thus, an impeller with several flow channels is created, which provides for an increased efficiency compared to impellers with only one flow channel. At the same time, on account of the design of the blades with the continuous gap, which extends from the inner edge of the blade to the outer edge of the blade, i.e., from the edge at the inner diameter to the edge at the outer diameter, one may ensure that long-fibered contamination may not get caught on the inner edges of the blades which face the suction port of the pump. This contamination would rather enter into the gap and be conveyed to the outer periphery of the impeller by way of the fluid flow.

The connection element between the two cover disks is preferably designed as a continuous blade connecting the two cover disks to one another. This means that this blade has no gap and is designed corresponding to the blades with conventionally covered impellers. The blade creates the firm connection between the two cover disks. In this manner, the connection element also supports the pumping effect of the impeller.

The cover disks are preferably connected to one another only via a single continuous blade. Accordingly, all further blades of the impeller are designed with a continuous gap, as described above. The danger of contamination accumulating in the impeller, is reduced to a great extent in this manner, since only a single blade has a continuous edge which is situated at the inner diameter and on which contamination may stick. Such contamination may not get stuck with regard to all other blades, since it may be led away to the outside through the gap on rotation of the impeller.

The gap in the blade or the gaps in the plurality of blades, particularly preferably, extend in the flow direction of a fluid to be delivered by the impeller. In this manner, one succeeds in enabling contamination, which has entered into the gap, to be conveyed in the movement direction of the fluid to the outer diameter of the impeller. This means that the fluid flow may entrain contamination in the gap, and convey it outwardly.

The impeller is particularly preferably designed as a preferably single-piece cast part of metal or plastic. Impellers of cast metal are preferably applied in particular with the use of waste-water pumps or pumps which deliver contaminated fluid, for example in the cooling lubricant circuit of machine tools, since these impellers have a high strength, and the danger of damage to the impeller by way of contamination is relatively small. Furthermore, one may also design impellers with a complex shape as a cast part of metal or plastic.

Alternatively, according to a further special embodiment, it is also possible to design the impeller of sheet-metal, in particular of stainless steel sheet-metal. There, the blades or the blade parts are preferably angled in an L-shaped manner in cross section, and are welded with one of the limbs to one of the cover disks. One may achieve a firm connection of the blades or blade parts to the cover disk, even if they are connected to a cover disk at only one axial end, on account of one of the limbs bearing on the cover disk in a surfaced-manner.

The edge of the blade situated at the inner diameter of the impeller, i.e., the inner edge of the blade, is preferably designed as a guide toward the entry of the gap, so that long-fibered contamination is led from the edge into the gap. For this purpose, the inner edge of the blade may, in particular, be beveled or rounded off, wherein the beveling or rounding-off runs toward the gap or the entry of the gap, at the inner diameter. Thus, long-fibered contamination, which would cling on the edge, would slip into the gap with the flow on account of the rounded-off or beveled shape, and be conveyed to the outside through this gap.

The invention further relates to a pump unit with an impeller according to the preceding description. This means that the pump unit with the previously described impeller is applied as a waste-water pump. Waste-water pumps as a rule deliver contaminated fluid; so that here, the previously described impeller has particularly advantages, since the danger of contamination sticking to the impeller is considerably reduced by the impeller according to the invention.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
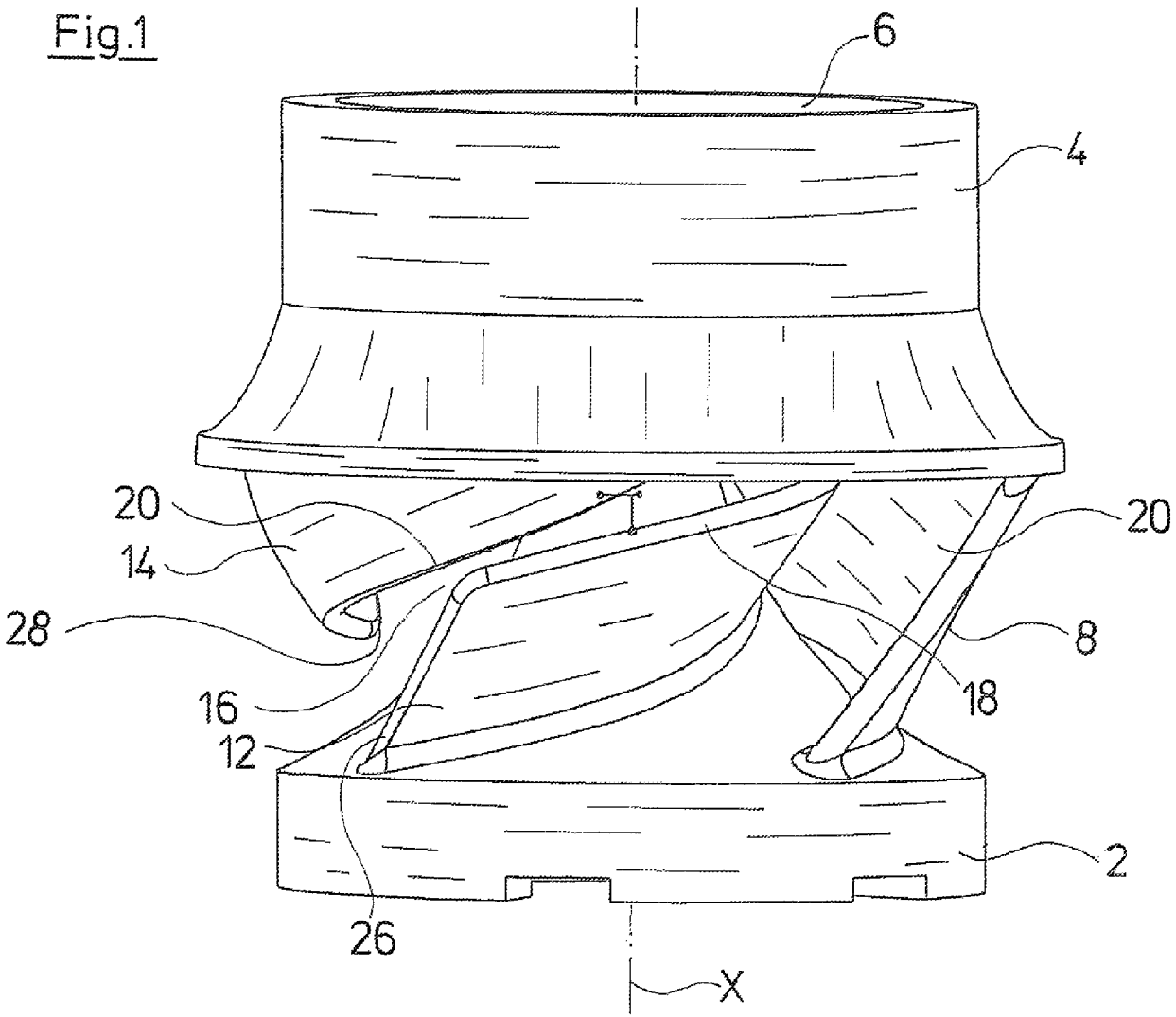
FIG. 1 is a lateral view of an impeller according to an embodiment of the invention.
Figure 2:
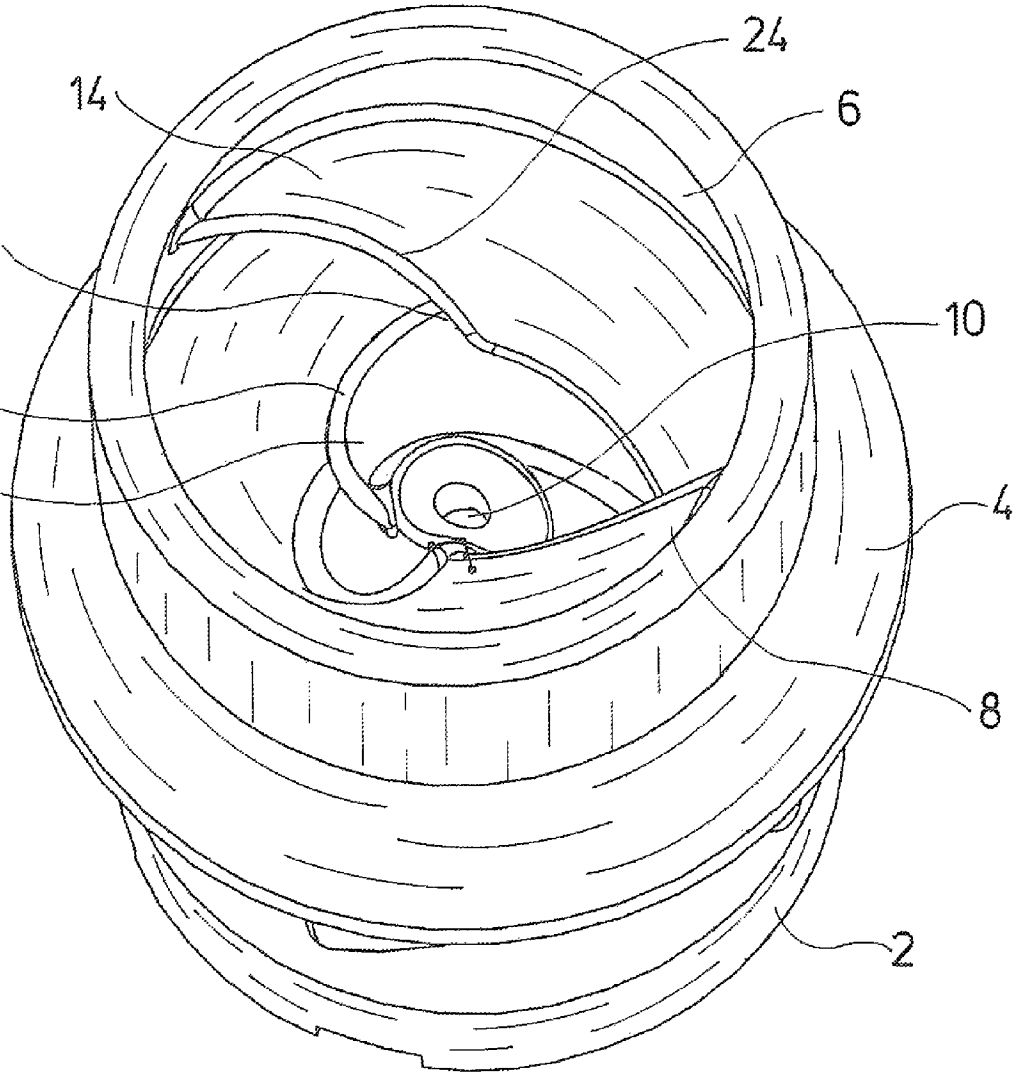
FIG. 2 is a perspective view of an impeller according to FIG. 1, with a view of the entry opening of the impeller.

The impeller comprises two cover disks 2 and 4, wherein the cover disk 4 comprises a central entry opening 6. The fluid to be delivered is suctioned through the entry opening 6 on rotation of the impeller about the rotation axis X.

A first blade 8 is arranged between the two cover disks 2 and 4, and is designed in a continuous manner and firmly connects the cover disks 2 and 4 to one another, so that these are held at a defined distance in the direction of the longitudinal axis X. Furthermore, the blade 8 ensures that the cover disk 4 together with the cover disk 2, rotates about the longitudinal axis X. The drive shaft for the impeller engages on the central opening 10 in the cover disk 2, so that the drive torque is transmitted onto the cover disk 2 and from this via the blade 8 onto the cover disk 4.

Apart from the continuous blade 8, the impeller further comprises a blade which is designed in a divided manner and which is formed of two blade parts 12 and 14. The blade part 12 is firmly connected to the cover disk 2, and the blade part 14 is firmly connected to the cover disk 4. The blade part 12 is preferably designed as one piece with the cover disk 2, and the blade part 14 as one piece with the cover disk 4. Particularly preferably, the complete impeller is designed as one piece of cast metal.

The blade parts 12 and 14 are arranged relative to one another, such that a gap 16 is formed between them. The gap 16 is designed in a manner such that the longitudinal edges 18 and 20 of the blade parts 12 and 14 are offset to one another in the peripheral direction, so that the gap 16 is formed in a plane which is curved here and which runs obliquely to the rotational axis X. There, the blade parts 12 and 14 overlap one another such that the free longitudinal edge 18 of the blade part 12 is situated closer to the cover disk 4 than the free longitudinal end 20 of the blade part 14. This means that no gap is formed between the blade parts 12 and 14 in the axial direction X, so that the fluid may not flow directly through the gap 16 in a plane transverse to the longitudinal axis X.

The lower cover disk 2 is designed in a conical or cone-like manner on its side facing the cover disk 4. Accordingly, the inner side of the cover disk 4 facing the cover disk 2 is designed in a conical manner. In this manner, a flow channel 20 is formed between the blade 8 and the blade formed from the blade parts 12 and 14, and this flow channel leads from the entry opening 6 to the outer periphery of the impeller. This means that guidance of the flow is effected in the flow channel 20 from the axial entry at the opening 6 to a radial exit at the outer periphery of the impeller. The gap 16 between the blade parts 12 and 14 extends along this flow channel 20 in the flow direction of the fluid roughly in the middle of the blade formed by the blade parts 12 and 14. There, the gap 16 extends from the inner edges 22 and 24 of the blade parts 12 and 14, which face the inner diameter of the impeller, to the outer edges 26 and 28 of the blade parts 12 and 14, which are situated at a diameter lying further to the outside, in particular on the outer periphery of the impeller.

The inner edges 22 and 24 are designed in a beveled manner, so that they run inclined to the entry of the gap 16 at the inner diameter of the impeller. Long-fibered contamination which clings to the inner edges 22 and 24 on rotation of the impeller, is led in the gap 16 in this manner. This means that the edges 22 and 24 are arranged such that they are not aligned normally to the peripheral direction, but inclined or obliquely to the peripheral direction. The edges are preferably furthermore designed in a rounded manner in the transition region to the longitudinal edges 16 and 18, so that long-fibered contamination may easily slip into the gap 16 and may slide over the longitudinal edges 16 and 18 to the outer periphery of the impeller. Since the gap 16 extends in the flow direction of the fluid to be delivered, the contamination in the gap is entrained by the fluid and is conveyed to the outside.

Furthermore, the gap 16 is designed such that it widens towards the outer periphery, i.e., has a greater width at its end facing the edges 26 and 28, than at the entry region facing the edges 22 and 24. In this manner, it is ensured that contamination which has entered into the gap, does not get stuck there and may be securely conveyed to the outside.

The described impeller is, in particular, suitable for application in a waste-water pump through which contaminated fluid is delivered. A cutting means may be arranged upstream of the impeller in the pump, in order to further reduce the danger of contamination accumulating in the impeller. The impeller is further suitable, in particular, for a pump designed in a single-stage manner. There, preferably a spiral housing, which deflects the fluid exiting radially from the impeller to a pressure stub of the pump which may extend in particular in the axial direction or parallel to the rotation axis X, is arranged downstream of the impeller in the flow direction.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An impeller for a pump unit, the impeller comprising two cover disks (2, 4) spaced from one another in an axial direction (X) of the impeller, the cover disks being connected to one another via at least one connection element (8), and at least one blade (12, 14) arranged between the two cover disks (2, 4), the at least one blade extending from an inner diameter of the impeller to an outer diameter of the impeller, wherein the at least one blade (12, 14) comprises a continuous gap (16) which extends from a first edge (22, 24) of the at least one blade (12, 14) situated at the inner diameter, to a second edge (26, 28) of the at least one blade (12, 14) situated at the outer diameter, the gap (16) dividing the at least one blade into two blade parts (12, 14), each of the two blade parts being connected to only one of the two cover disks (2, 4).

2. The impeller according to claim 1, wherein the at least one blade (12, 14) is connected to only one of the two cover disks (2, 4).

3. The impeller according to claim 1, wherein the two blade parts (12, 14) in a region of the gap (16) are arranged offset to one another in a peripheral direction of the impeller.

4. The impeller according to claim 3, wherein the two blade parts (12, 14) are designed with a length in the axial direction (X), such that the parts overlap one another in the axial direction (X) in the region of the gap (16).

5. The impeller according to claim 4, wherein the overlapping of the blade parts (12, 14) changes, and in particular reduces, in a course of the blade from the inner to the outer diameter of the impeller.

6. The impeller according to claim 5, wherein the overlapping of the blade parts (12, 14) reduces in a course of the blade from the inner to the outer diameter of the impeller.

7. The impeller according to claim 1, wherein the gap (16) widens in a course of the at least one blade (12, 14) from the inner to the outer diameter of the impeller.

8. The impeller according to claim 1, wherein several blades (12, 14) having a continuous gap (16) are arranged between the two cover disks (2, 4).

9. The impeller according to claim 1, wherein the connection element is designed as a continuous blade (8) connecting the two cover disks (2, 4) to one another.

10. The impeller according to claim 9, wherein the two cover disks (2, 4) are only connected to one another via a single continuous blade (8).

11. The impeller according to claim 1, wherein the gap (16) in the at least one blade (12, 14) extends in a flow direction of a fluid to be delivered by the impeller.

12. The impeller according to claim 1, wherein the impeller is a single-piece cast part comprising metal or plastic.

13. The impeller according to claim 1, wherein the impeller is formed of sheet-metal, wherein the at least one blade (12, 14) is angled as an L-shape in cross section, and a limb of the L-shape is welded to one of the cover disks (2, 4).

14. The impeller according to claim 13, wherein the sheet-metal is stainless steel.

15. The impeller according to claim 1, wherein the first edge (22, 24) situated at the inner diameter of the impeller is designed as a guide to entry of the gap (16), such that long-fibered contamination is led from the first edge (22, 24) into the gap (16).

16. The impeller according to claim 1, wherein the pump unit is for a waste-water pump assembly.

17. A pump unit comprising an impeller according to claim 1 and designed as a waste-water pump.

* * * * *